United States Patent [19]

Roncon

[11] 4,083,334

[45] Apr. 11, 1978

[54] HYDRAULIC VALVE LIFTER

[76] Inventor: Carlos Alberto Ferrari Roncon, Rua Conde de Sabugasa, 25-3°-D-, Lisbon 5, Portugal

[21] Appl. No.: 449,895

[22] Filed: Mar. 11, 1974

[30] Foreign Application Priority Data

Apr. 26, 1973 Portugal ..... 59753[U]

[51] Int. Cl.[2] ..... F01L 1/14; F01L 1/22; F01L 1/24

[52] U.S. Cl. ..... 123/90.35; 123/90.55; 123/90.58

[58] Field of Search ..... 123/90.35, 90.55, 90.56, 123/90.5, 90.51, 90.58

[56] References Cited

U.S. PATENT DOCUMENTS

| | | | |
|---|---|---|---|
| 2,818,050 | 12/1957 | Papenguth | 123/90.35 |
| 2,874,685 | 2/1959 | Line | 123/90.55 |
| 2,908,260 | 10/1959 | Bergmann | 123/90.55 |
| 3,014,472 | 12/1961 | Wisman | 123/90.55 |
| 3,053,239 | 9/1962 | Pechenik | 123/90.35 |
| 3,448,730 | 6/1969 | Abell | 123/90.35 |
| 3,476,093 | 11/1969 | Line | 123/90.35 |
| 3,598,095 | 8/1971 | Ayres | 123/90.35 |
| 3,614,942 | 10/1971 | Erickson | 123/90.35 |
| 3,875,911 | 4/1975 | Joseph | 123/90.35 |
| 3,967,602 | 7/1976 | Brown | 123/90.35 |

*Primary Examiner*—Charles J. Myhre
*Assistant Examiner*—R. A. Nelli
*Attorney, Agent, or Firm*—Ostrolenk, Faber, Gerb & Soffen

[57] ABSTRACT

A hydraulic valve lifter is provided with a socket or seat for a hollow pushrod, the socket being constructed with three diameters, of which the uppermost is of largest size and is concentric with the outside surface of the plunger, the lowest socket section being of smallest diameter and being force-fitted into the plunger, while the intermediate socket section forms with the unbroken inner surface of the body, an annular passageway for oil constituted of a clearance of constant radial width to a transverse bore in the socket. The socket and plunger are ground together to obtain complete concentricity, and the clearances about the top section of the socket and about the plunger are of the same order, so that concentricity between the combined socket and plunger on the one hand, and the inner surface of the body of the lifter on the other, is maintained, the low clearance about the top section of the socket providing a stopper effect in contrast to the much wider clearance afforded by the intermediate section of the socket. Because of the concentricity, a constant average leakdown time is assured in any condition of the parts, while at the same time the lifter meters the oil to the valve train, so as to provide always substantially the same flow of oil in any condition of the lifter, and the lifter operates to self-clean the system if a particle of foreign material is entrained in the oil, relative movement between plunger and body being always maintained.

14 Claims, 5 Drawing Figures

FIG. 1
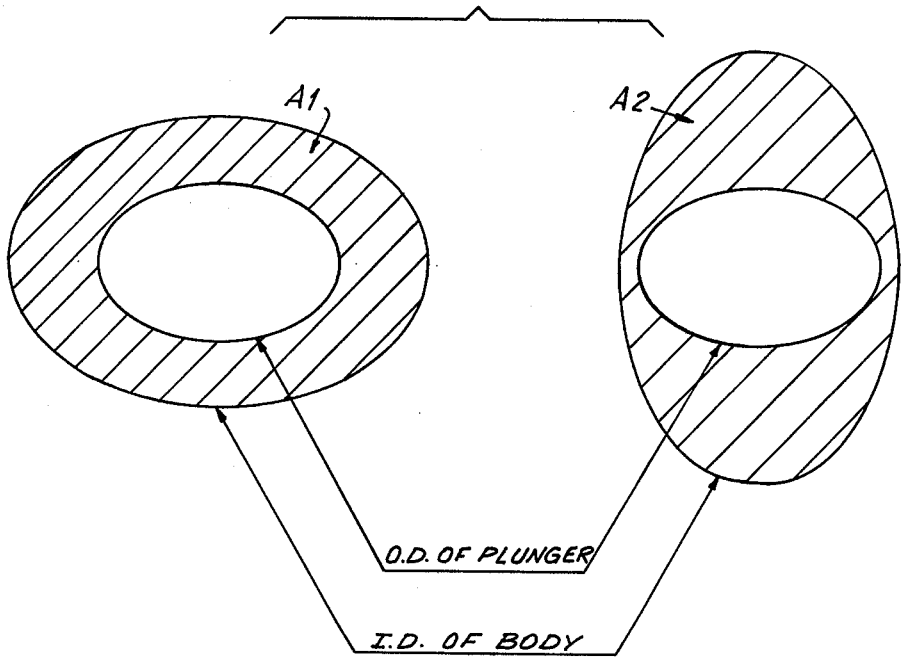
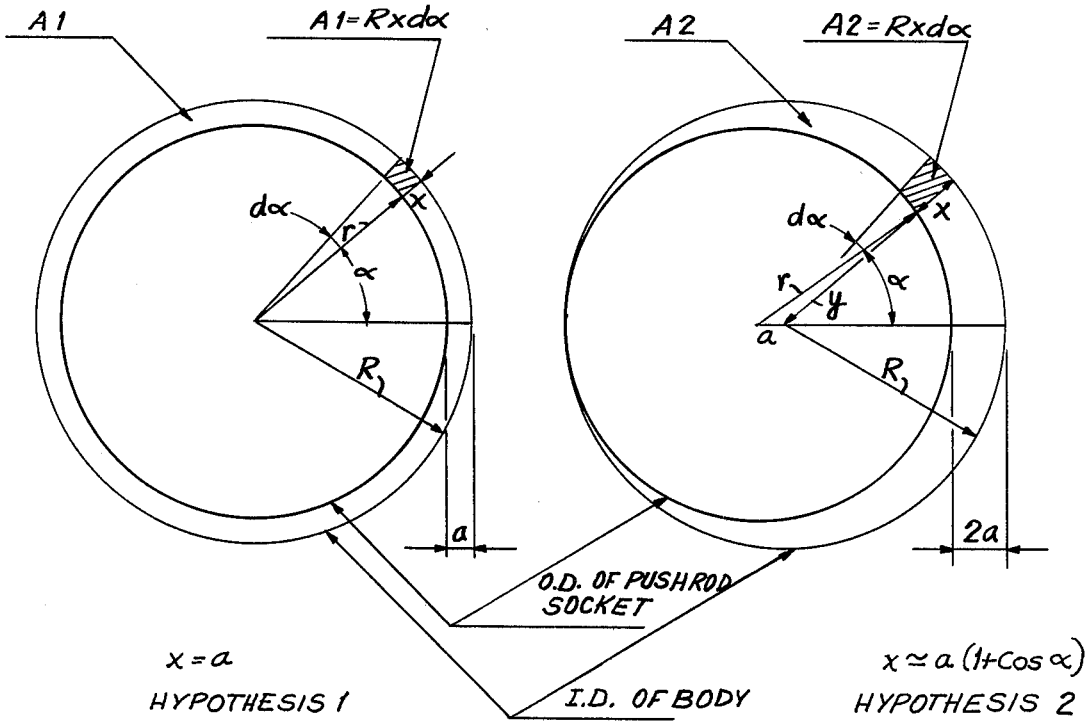
FIG. 2

FIG. 3
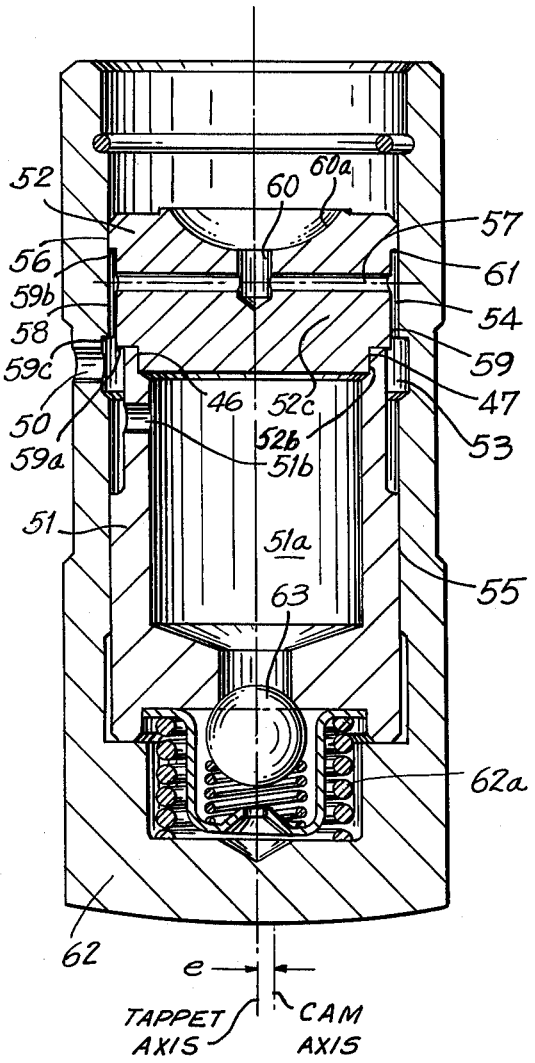
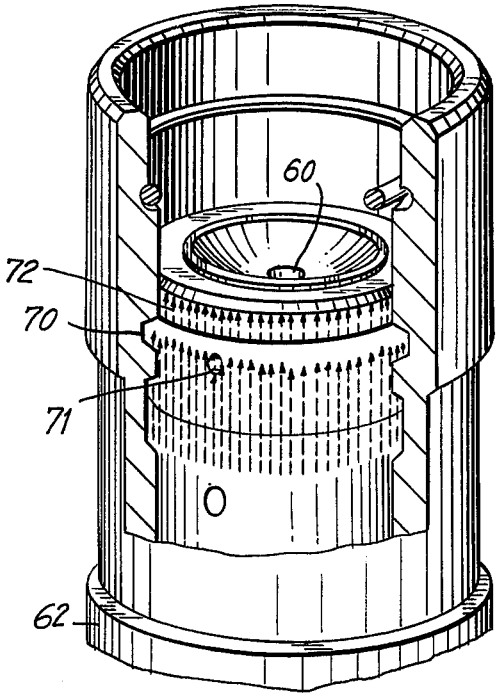
FIG. 4
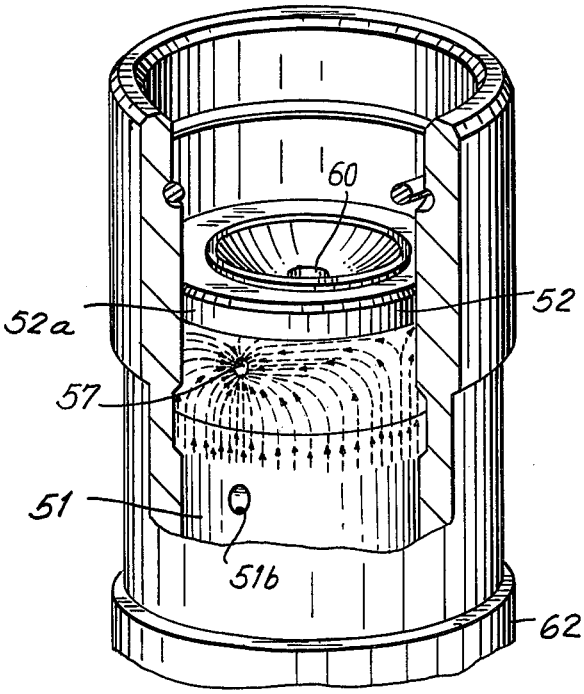
FIG. 5

HYDRAULIC VALVE LIFTER

BACKGROUND OF THE INVENTION

In internal combustion engines, mainly in the overhead valve models, the valves are cyclically opened and closed during the rotation of the motor through one or more camshafts. These camshafts move the valves by a transmission as shown, for example, in the patents to Papenguth, U.S. Pat. No. 2,818,050, issued Dec. 31, 1957, and Abell U.S. Pat. No. 3,448,730, issued June 10, 1969, and comprising a cam, a lifter or tappet, a pushrod, a rocker arm which oscillates about its fulcrum, and an intake or exhaust valve.

In order to provide an automatic compensation of the varying lengths of the above-indicated kinematic transmission due to thermal variation during the functioning of the motor, there is in widespread use as lifter an hydraulic valve lifter, operating between the cam on the camshaft and the pushrod. Its constitution may vary, but it is basically composed of a cup-shaped cylindrical body that houses all the other parts of the lifter, a pushrod socket, a hollow plunger of cylindrical shape and a check valve mounted at the lower extremity of the plunger which may be in the form of a ball acted on by a spring within a spring holder. These three parts are assembled in the bottom of the plunger and they allow the free flow of oil from an oil reservoir within the plunger to a reservoir at the bottom of the body, but they prevent the opposite flow. This assembly is pushed up in the direction from cam to pushrod by a spring and is retained within the body by a snap ring.

In this hydraulic valve lifter, the relative position of all parts in contact with the pushrod (all except the body and snap-ring) and the position of the body, are variable and infinitely adjustable. To effect this result, the lifter should be fully filled with oil, supplied by the motor, which enters through the body cross-hole to an annular groove, in the interior surface of the body, from such groove to a groove on the outer wall of the plunger, the dimension of these two grooves being so calculated that there is always communication between them in any relative position of the plunger and body, and through the cross-hole of the plunger into the oil reservoir of the latter. This oil flows through the check valve into the oil reservoir in the body every time the spring pushes the plunger in the direction toward the pushrod, which happens every time there is a clearance in the kinematic transmission and the oil reservoir in the body is not fully filled with oil. It is obvious that in a short time after start of the engine, the oil reservoir in the bottom of the body will be fully filled with oil.

For a correct functioning of the lifter, it is necessary that the oil should not easily get out of the reservoir in the body, but it is necessary that some oil should leak out, to allow for the change of length of the valve train as required. The well-known solution consists in assembling the body and plunger with a very small clearance (about 0.006 millimeters on the diameter) to allow for only a small leakage of oil between them, through such clearance. To control this leakage value, it is usual to establish two experimental times ($t_0$ and $t_1$) such that, when a constant force F in the direction pushrod to cam is applied on the pushrod of a fully filled hydraulic valve lifter, the plunger must take a certain amount of time $t$, to move along a predetermined travel; this time $t$ is known as "leakdown time" and it should be such that $t_0 \leqq t \leqq t_1$.

This test, called "leakdown test," is then a simulation of the real functioning of the motor. It is here that there arises one of the problems that my invention is intended to solve, which I shall refer to as PROBLEM 2, and will be fully explained below.

It is usual to use this hydraulic valve lifter for another purpose besides the one above indicated. In fact, for greater durability of the motor, any friction point should be carefully lubricated. So, the contact point of the pushrod in the rocker arm, the rocker arm bearing and the contact point of the rocker arm on the valve rod should be carefully lubricated. This lubrication was formerly effected through an independent oil gallery, but nowadays is generally made through the pushrod itself, which is a tubular member and receives the oil through the hydraulic lifter. For this purpose, the lifter has near the open end of the body an axial hole in the socket through which there flows the oil needed for the lubrication of the valve train.

It is essential that the amount of oil should be carefully controlled to avoid insufficient lubrication, on the one hand, which could cause the parts to stick together, or, on the other hand, too much oil should likewise be avoided, as this would lead to an excess of oil in the cylinder head, which would drain along the valve rod and be burnt and lost in the motor. It is here that there arises another problem that my invention seeks to solve, and which I refer to as PROBLEM 1, which will be fully explained hereinbelow.

Finally, for a complete knowledge of this mechanism it is necessary to remark that another movement exists besides the axial one, namely, between the body and the plunger. In fact, the lifters are mounted in an eccentric position on the cam, so that an eccentricity "*e*" always exists. In consequence, the rotation of the cam about its axis induces a rotation of the tappet about its axis too. This rotation has for its object to avoid a constant wearing point of contact between the cam and tappet. With this construction, the contact point rotates about the axis, leading to a more lasting tappet.

DESCRIPTION OF THE PROBLEMS

PROBLEM 1 — LUBRICATION OF THE VALVE LIFTER

Due to the normal pressure of oil in internal combustion engines and to the low flow of oil required for the above-described lubrication, the path of the oil from the oil-admitting cross hole in the body to the vertical hole in the socket could not be unrestricted. There accordingly has to be introduced an important hydraulic resistance to reduce the flow of oil to the desired value. The easiest way would be to make the oil flow through a very small hole. But, for practical purposes, the diameter of this hole would have to be so small that any solid impurity carried by the oil would block the hole and stop the lubrication.

A properly operating system would therefore have to satisfy three conditions:

1. It should have a high hydraulic resistance to allow for a relatively small flow rate of oil;
2. It should be very constant despite the variation of the following geometrical variables:
   (a) axial position of the pushrod in the body;
   (b) angular position of the pushrod in the body, because these values vary during the running of the engine.

3. It should avoid any blocking due to the small solid impurities that might be carried in by the motor oil, and if such impurities should occur it should have a self-cleaning action to avoid any restriction of the oil flow.

PROBLEM 2 — TAPPET LEAKDOWN

As indicated above, for a correct functioning of the hydraulic lifter the clearance between plunger and body should be about 6 microns = 0.006 mm. on the diameter. According to present practice, the body and plunger are, respectively, internally and externally ground and are classified or sorted in categories for a selective assembly in order to have always this limited clearance. Unfortunately, the grinding machines available for mass production, even the latest models, introduce in the ground surfaces geometrical errors, such as out-of-roundness, lobuling, etc. These errors, although very small in magnitude (up to 2 microns) are, however, of the order of the required clearance, and hence figure prominently in the over-all result.

In FIG. 1 there is shown, highly exaggerated, the two extreme possibilities of assembling an out-of-round plunger in an out-of-round body. Although the areas of the cross-sections are the same ($A_1 = A_2$) the hydraulic resistance is very different in the illustrated examples (see mathematical demonstration below). And, as the geometrical errors are not avoidable in mass production, the leakdown rate in a tappet is not always constant but changes with the relative angular position between the body and the plunger. Nevertheless, it is possible in a tappet, pursuant to the present invention, to provide a constant median leakdown rate if the body and the plunger have a relative angular motion. As the body rotates about its axis, it is possible to get the desired relative rotation if the plunger is kept stationary against rotation.

Methods Used Up To Now To Solve The Above-Stated Problems And Their Inadequacies

TO SOLVE PROBLEM 1

Some methods have been used to solve or ameliorate the just-mentioned problems, from among which may be mentioned the following:

1. Use of a valve with a generally small port, but which opens fully when an impurity appears in the oil. This method is very expensive and has an irregular functioning at low and high speeds of the motor.

2. Use of a tortuous path—the oil has to pass along a labyrinth between the entry port or cross-hole in the body and the vertical hole in the socket leading to the pushrod. These systems could not entirely avoid the problem of blocking of the flow due to solid impurities and subsequent loss of lubrication in the valve train.

3. Use of a laminar flow of oil between the body and the pushrod socket. This system uses for hydraulic resistance a calibrated clearance between the I. D. of the body and the O. D. of the pushrod socket. Thus, in one form of this construction, the socket is of uniform diameter facing the body, and in the attempt to create a uniform hydraulic resistance, it has been suggested to provide a constant metering length along the facing surfaces, but this does not solve the main problem of this system; namely, that for the normal required metering of oil the clearance on the diameter between the pushrod socket and the body should be about 50 microns. If for this clearance value, the geometrical errors, i.e., any non-circular shapes of the socket, plunger and inner wall of the body, are now relatively unimportant (contrary to what they are with reference to a clearance of 6 microns), the fact is now very important for the oil flow that the relative position between the pushrod socket may vary between the two extreme positions shown in FIG. 2, either by parallel shifting of their axes out of coincidence, or by their axes becoming askew relative to each other. Although the cross-sectional flow areas are the same for both situations, the amount of oil metered is quite different. To see this, it is enough to note that the flow is highly dependent on the clearance between the adjacent surfaces, but the dependence is not a linear one. To show this mathematically, I shall calculate the ratio between the rates of flow $Q_1$ and $Q_2$ in the sections $A_1$ and $A_2$ of FIG. 2 for identical geometrical and hydraulic conditions — identical pressure $P_i$ in the reservoir space about the top of the plunger into which the oil entry port in the body debouches, identical pressure $P_f$ in the vertical hole in the socket, identical flow length along the annular clearance, and kinematic viscosity $\nu$, and assuming the oil to be a Newtonian liquid.

If R is the radius of the inner surface of the body and $r$ the radius of the outer surface of the pushrod socket, assumed as being perfectly cylindrical for this purpose, the radial clearance in the centered position is $$a = R - r$$

In this annular flow the Reynolds number is $$Re = (2a/\nu) \times V_{average}$$

where $\nu$ is the viscosity and $V_{average}$ is the average speed of flow.

The flow will be laminar if $Re \leqq 2.000$. For normal values of $a$ = 25 microns = $25 \times 10^{-6}$ meters and $\nu$ = 1.5 centistokes, there is a laminar flow if $V_{average} \leqq 600$ meters/sec., which is obviously the situation.

The calculations of the flow rate hypothesis of FIG. 3 will be carried out assuming "$a$" very small relatively to R ($a/R \simeq 0.0003$).

The flow rate in an annular section of radii R and $r$, where $R = Kr$ ($K$ a constant) and $R - r = X$, is $$Q = C\left(1 - K^4 - \frac{1 - K^2}{\ln K}\right)^*,$$

where C is a constant of the problem depending only on the geometrical conditions and on $P_i$, $P_f$ and $\nu$. The cross-sectional area of this section is $A = 2\pi RX$.

Expanding in a Taylor powers of (K−1) and considering that $K \simeq 1$ and taking only the highest order terms, we have $$Q = \frac{14}{3} C(K-1)^2 \ldots = \frac{14}{3} C(1-K)^2 = \frac{14}{3} C \frac{X^2}{R^2}$$

the average flow in the elementary area $dA = XR\, d\alpha$ will be $$dQ = \frac{Q}{A} dA = \frac{7}{3\pi} \frac{C}{R^2} X^2 d\alpha.$$

Comparing now the hypotheses 1 and 2 of FIG. 2 we have:

Hypothesis 1: X = $a$
So $$Q_1 = \int_o^{2\pi} dQ = \int_o^{2\pi} \frac{7}{3\pi} C \frac{a^2}{R} d\alpha = \frac{14}{3} C \frac{a^2}{R^2}$$

Hypothesis 2:
By the Carnot theorem we have from FIG. 2:

$$r^2 = y^2 + a^2 + 2ay \cos \alpha, \text{ or } (R-a)^2 = (R-x)^2 + a^2 + 2a(R-r)\cos \alpha.$$

Taking only the terms of first order in $a$ and $x$, we have $$x \simeq a(1+\cos \alpha).$$

The elementary rate of flow in the area $dA_2$ will be as in hypothesis 1:

$$dQ_2 = \frac{7}{3\pi} \frac{C}{R^2} x^2 d\alpha = \frac{7}{3\pi} C \frac{a^2}{R^2} (1 + \cos \alpha)^2 d\alpha$$

and the total rate of flow in the area $A_2$ will be $$Q_2 = \frac{7}{3\pi} C \frac{a^2}{12^2} \int_o^{2\pi} (1 + \cos \alpha)^2 d\alpha = 7 C \frac{a^2}{R^2}$$

The ratio between the two rates of flow will then be $$R = \frac{Q_2}{Q_1} = \frac{7 C \frac{a^2}{R^2}}{\frac{14}{3} C \frac{a^2}{R^2}} = \frac{3}{2}$$

Hence, under hypothesis 2, the rate of flow is 50% higher than under hypothesis 1.

TO SOLVE PROBLEM 2

So far as I am aware, there is no system currently in use which in fact assures a relative rotation between the body and the plunger. Actually, the highest frictional regions are between the pushrod and the pushrod socket and between the cam and the body. The first region makes the pushrod socket stationary against rotation, and the second region causes the body to rotate. But it is uncertain which movement will take with it the plunger. If an impurity should lie between the body and the plunger it will impede any movement relative to the body and will rotate with it, giving way possibly to an incorrect leakdown time.

The present invention will be further described with the aid of FIGS. 3 to 5, FIGS. 1 and 2 having been already referred to hereinabove. Of FIGS. 3 to 5, FIG. 3 is a central axial section of a valve lifter or tappet constructed in accordance with the invention;

FIG. 4 is a view illustrating schematically the nature of the oil flow in known tappets, such as that of the Abell patent referred to hereinabove; while FIG. 5 is a view similar to FIG. 4 but showing the character of the oil flow in the tappet of FIG. 3.

SOLUTIONS OF THE INVENTION

The solution of Problem 1 consists in forming the socket 52 (FIG. 3) with three diameters, the topmost section 52*a* having the largest diameter and the lowest section 52*b* having the smallest diameter, and causing the lubricating oil to flow along an annular clearance zone 54, formed by the inner surface of the body and the outer surface of the intermediate section 52*c* of the socket. This annular passageway 54 provides a uniform flow by reason of the fact that, in accordance with the invention, the socket 52, plunger 51 and body 62 are maintained substantially concentric in all their relative positions. The outer diameters 56 and 59 of the top and intermediate sections of the socket are machined with great precision. One, diameter 56, has the minimum clearance with respect to the I. D. of the body. The second, diameter 59, has the necessary clearance to allow for the required flow rate of oil to the transverse bore 57 in the socket.

As shown in FIG. 3, the socket is force-fitted into the top end section of plunger 51 by way of its lowest section 52*b*, so that the socket and plunger are in effect a unitary member, i.e., there is zero clearance therebetween. After the force fitting, the outer surfaces of sections 52*a*, 52*c* and plunger 51 are ground together, so that they are perfectly concentric. Once assembled in the tappet there is formed, between the body and the pushrod socket, the annular passageway 54 which is maintained with constant radial width for any axial or angular relative position of the body and pushrod socket, as explained hereinabove in connection with FIG. 2. The close fitting of the top section of the pushrod socket in the body avoids any material radial displacement of the socket, so that the cross-section of the annular passageway 54 will always show a form very similar to the hypothesis 1 of FIG. 2 and never similar to the hypothesis 2 which occurred in the prior art, thus leading to a constant flow rate under all conditions.

In the embodiment of FIG. 3, the oil enters by way of the cross-hole 50 of the body 62 and the groove 53 about the upper portion of the plunger 51. It flows through port 51*b* into the reservoir 51*a* of plunger 51 in known manner, and also flows along the annular passageway 54 formed by the outer surface 59 of section 52*c* of the socket, and limited upwardly by the lower face 61 of the shoulder formed by the largest outer diameter 56 of the socket. The oil then flows through the transverse bore 57 of the pushrod socket into the axial hole 60, from where it lubricates the valve train by way of a hollow pushrod (not shown) in known manner.

In the tappet of FIG. 3, as above indicated, the pushrod socket is press-fitted with the plunger prior to the concentric grinding. Hence, in view of the concentricity, relative angular motion between plunger and body is assured so long as the body rotates and the pushrod socket is kept stationary with the pushrod, so far as angular motion about the axis is concerned. The concentricity is maintained by reason of the fact that the clearance on the diameter about section 52*a* is about 6 to 14 microns (the larger value being due to the taper of the tool which machines the inside surface of the body), while the clearance about the plunger is likewise about 6 microns on the diameter, so that the axis of the socket - plunger combination can almost depart from the axis of the body to only a negligible extent. So in the construction of FIG. 3, Problem 2 has been solved too, and the median leakdown rate of the tappet is maintained constant.

The problem in FIG. 2 is accordingly solved by ensuring relative rotation between the body and plunger.

This is easily accomplished with the two-piece tappet consisting of the body and the combined plunger and socket. Because of the high frictional points between the body and cam, which effects rotation of the body, and between the socket and pushrod, which causes the pushrod to remain fixed so far as rotation about the central axis is concerned, relative rotation between body and plunger-socket is promoted and self-cleaning more fully accomplished. In the case of a 3-piece tappet, on the other hand, i.e., wherein the socket is rotatable relative to the plunger, the same reasons apply to the body and pushrod, but the rotation of the plunger is out of control. It can rotate with the body or remain stationary with the pushrod.

It will be noted that in the construction of FIG. 3 the inner surface of the body confronting the socket is devoid of the frequently employed collecting groove which feeds into the transverse bore 57. The oil thus flows freely from the increased clearance 54 directly into the transverse bore as shown in FIG. 5. This contrasts with the known tappets, such as that shown in FIG. 4, wherein the oil flows into a collecting groove 70 in the body opposite the transverse bore 71 and is at the same time free to travel upwardly beyond the groove and overflow the socket, as indicated by arrows 72. In my improved construction, because of the reduced clearance about section 52*a*, the oil finds the transverse bore 57 the path of least resistance.

As is known, the oil enters the tappet through the port 50 in the body 62 and enters a reservoir space at the top of the plunger 51 formed by the groove 53 therein. The oil enters a reservoir 51*a* in the interior of the plunger through a port 51*b*. From reservoir 51*a* the oil can flow past a check valve 63 and into a reservoir at the bottom of the body, as indicated at 62*a*. The construction at the bottom of the plunger and body is well-known and will therefore not be further described.

The oil flows from the groove 53 past the shoulder 59*a* at the bottom of the intermediate section 52*c* and into the annular passageway 54. Part of the oil passes into the transverse bore 57 while approximately all of the remainder is reversed in its flow by the shoulder 59*b*, as indicated in FIG. 5, and returns to the transverse bore 57. The reduced clearance 56 has a stopper effect and minimizes flow of oil to the upper surface of the socket. It will be noted that the shoulder 59*a* extends a considerable distance below the shoulder 59*c* in the wall of the body when the plunger is in its lowermost position as shown in FIG. 3. This extension of shoulder 59*a* below shoulder 59*c* may be as much as half the length of the stroke of the plunger.

The intermediate portion 52*c* of the socket being of smaller diameter than the upper section 52*a* provides the widened annular oil passageway 54 which preferably has a clearance of about 50 to 60 microns on the diameter. The passageway preferably extends for a considerable distance above the transverse bore 57 of the socket, which may amount to about 1½ to 4 mm. This bore feeds into the vertical hole 60 which conducts the oil to a seat 60*a* that supports the hollow pushrod (not shown) whose bottom is provided with a port communicating with the hole 60.

The following method can be conveniently employed in providing the above-mentioned concentricity of the outer surfaces of the plunger and socket: After suitably roughly shaping the socket and plunger, the lowest section of the socket of smallest external diameter is force-fitted into the open top portion of the plunger, so that in effect the socket and plunger are converted into a unitary member. The socket-plunger combination is then mounted on a fixed axis and rotated thereabout and simultaneously ground.

It will be seen from the foregoing that I have provided a hydraulic valve lifter in which the socket and plunger members are initially separate from each other, so that they can be machined or otherwise finished internally without difficulty; and which, after being force-fitted together, act as a single unit, so that the plunger section is held against rotation about the tappet axis by reason of the frictional resistance between the bottom of the pushrod and the socket member; in consequence of which, the body can be rotated by the off-center cam with reference to the plunger. Also, because of the low clearance between the topmost section of the socket and the internal surface of the body, which is of the order of 6 microns and thus similar to the clearance about the lower portion of the plunger, the plunger-socket unit is maintained in line with the central longitudinal axis of the tappet and hence the leakdown rate is maintained substantially constant during the reciprocations of the tappet.

I claim:

1. In an hydraulic valve lifter comprising a body having an external generally cylindrical shape and an interior wall defining a cylindrical cavity extending from an open end of the said body to a closed end thereof, and including a first cross port between the outer and inner surfaces of the body and leading into an oil reservoir within the body;

a plunger assembled within said body for reciprocation therein and having an outer generally cylindrical shape which fits with a very small clearance within the inner surface of said body, the interior of the plunger defining an oil reservoir, a second cross port between the outer and inner surfaces of said plunger communicating with the first cross port;

a check valve mounted within the bottom portion of said plunger so as to allow the flow of oil from the plunger reservoir to the reservoir in said body but prevents the opposite flow;

the combination of a separately constructed pushrod socket which is force-fitted into said plunger, said socket being of cylindrical shape and having two diameters above the plunger, of which the larger upper one fits with a very small clearance against the inner surface of said body, and the smaller lower one defines with the inner surface of said body an annular zone;

a first groove formed in the inner surface of said body which through the first said port communicates with the exterior of said body;

a second groove formed in the outer surface of said plunger which through said second port communicates with the said plunger reservoir and is located at such a height that in any relative position of said plunger and body said second groove of the plunger always overlaps said first groove of said body;

a transverse bore in said pushrod socket which communicates with a central axial hole of the socket but does not directly communicate with the plunger reservoir, said transverse bore communicating also with the said annular zone and allowing the free flow of oil from the said annular zone to the axial hole of the socket;

there being an hydraulic connection between the first port of said body and the axial hole of the socket through said first groove, through said annular zone, and through said transverse bore of the socket, whereby the hydraulic resistance concentrates almost exclusively in said annular zone.

2. A valve lifter according to claim 1, wherein the socket is press-fitted in said plunger by way of its bottom section of smallest diameter in order to prevent the plunger from rotating against the body, whereby a constant average leakdown rate of said hydraulic valve lifter is provided.

3. A valve lifter according to claim 1, wherein the outer surfaces of the top portion of the socket of largest diameter and the outer surface of the plunger are concentric to such an extent as to prevent any material non-axial positioning between them and the body.

4. In a hydraulic valve lifter, the combination of a body having a cylindrical inner surface and closed at its bottom end, a plunger within the body having a valve-controlled lower end and an open upper end, a socket formed of three sections of progressively decreasing diameters from the top to the bottom thereof, said socket being force-fitted into the open end portion of the plunger by way of its lowest section, thereby providing an annular passageway for oil about its intermediate section, a transverse bore in the intermediate section of the socket communicating with the annular passageway, said socket having a seat for a hollow pushrod and provided with a central vertical hole communicating with the transverse bore, an oil inlet port through the body and a registering port in the plunger for charging oil into the interior of the plunger, the top section of the socket and the plunger being ground concentrically with respect to each other and to the inner surface of the body, the clearance between the plunger and body being about 6 to 9 microns and the clearance between the top socket section and the body being of the same order, whereby the socket and plunger on the one hand and the body on the other are maintained constantly in substantial axial alignment whereby the leakdown rate between the plunger and body is maintained substantially constant for all positions of the plunger.

5. A hydraulic valve lifter according to claim 4, wherein the annular passageway about the intermediate section of the socket extends for a distance of about 1½ to 4 mm. above the transverse bore.

6. A hydraulic valve lifter according to claim 4, wherein the shoulder formed between the intermediate and bottom sections of the socket extends below a shoulder on the inner surface of the body and defines the lower edge of the portion of the body surface forming with the intermediate section of the socket the aforementioned annular passageway.

7. A hydraulic valve lifter according to claim 6, wherein the annular passageway extends for a distance of 1½ to 4 mm. above the transverse bore.

8. A hydraulic valve lifter according to claim 4, wherein the inner surface of the body facing the socket sections above the plunger is devoid of an annular collecting groove, whereby the oil flowing upwardly through the annular passageway flows directly into the transverse bore of the socket.

9. In a hydraulic valve tappet comprising a body having a port for entry of oil under pressure, and a socket and hollow plunger arranged for reciprocating movement relative to the body as the engine valve is opened and closed, the socket provided with a seat for supporting a hollow push rod having a port at its bottom which is in communication with a vertical bore in the socket, said socket having a transverse bore communicating with the vertical bore, the plunger having a port communicating with the first port for charging oil into the interior of the plunger, the provision of a socket having a lower section of reduced diameter compared to the diameter of the upper section of the socket, said reduced diameter extending at least to the said transverse bore, said reduced socket diameter forming with the facing wall of the body an annular passageway providing a clearance substantially greater than that about the upper socket section, both said body and said socket being devoid of an annular collecting groove in the vicinity of the transverse bore and communicating directly herewith, so that the oil flows directly from said passageway into said bore.

10. A hydraulic tappet according to claim 9, wherein the clearance about the upper section of the socket is of the order of 6 to 14 microns, while the clearance about the lower, reduced section of the socket is of the order of 50 to 60 microns, while that about the plunger is 6 to 9 microns.

11. A hydraulic tappet according to claim 9, wherein the socket and plunger are force-fitted together and their outer surfaces ground concentrically whereby substantial coincidence of the central longitudinal axes of the inner wall of the body and of the socket; plunger member is maintained, and the oil flow through the annular passageway is continuously of tubular form and of substantially uniform radial thickness, while the median leakdown rate about the plunger is maintained substantially constant in all positions of the socket-plunger member relative to the body.

12. A hydraulic tappet comprising a cylindrical body and a socket and plunger assembled therein, said socket having a transverse bore and a seat for a hollow pushrod, said seat communicating through an axial hole with the transverse bore, said transverse bore, in all relative positions of the socket and body, facing at its ends a smooth unbroken surface of the inner wall of the body, the transverse bore being in communication with an annular passageway formed by a reduced section of the socket, the upper section of the socket being of larger diameter than the lower portion thereof, the clearance between the section of the socket above the transverse bore and the body being so much less than the clearance between the reduced lower section of the socket and the body, that flow of oil therethrough is impeded, whereas oil can flow relatively freely upwardly through the said annular passageway and directly into the transverse bore, the clearance between the plunger and body being of the order of that about the upper section of the socket.

13. A hydraulic valve lifter comprising a body, a hollow plunger disposed in said body and a socket closing the upper end of the plunger, said socket having an upper section of larger diameter spaced from the cylindrical wall of the body by a clearance on the diameter of about 6 to 14 microns, a lower section of the socket being of reduced diameter to provide an oil passageway between itself and the wall of the body, said passageway having a considerably larger clearance between itself and the wall of the body to provide a path of lower resistance to oil flow than in the clearance about the upper section, a transverse bore in the socket opening into said annular passageway, a vertical hole in the socket communicating with said transverse bore and opening into a pushrod seat, a port in said body for the entry of oil, the inner surface of the body having a groove in the region of said port to provide a reservoir for the oil, there being a shoulder formed at the upper edge of said groove the lower section of the socket having a shoulder at its lower end which, in the lowermost position of the plunger, is disposed a substantial distance below the shoulder on the inner surface of the body.

14. A hydraulic valve lifter according to claim 13, wherein the shoulder at the bottom of the lower section of the socket extends below the shoulder in the inner wall of the body when the plunger is in its lowermost position for a distance equal to approximately half the stroke of the plunger.

* * * * *